US010508452B2

(12) United States Patent
Hooper

(10) Patent No.: US 10,508,452 B2
(45) Date of Patent: Dec. 17, 2019

(54) PRIVACY SCREEN

(71) Applicant: Judith A. Hooper, Big Rapids, MI (US)

(72) Inventor: Judith A. Hooper, Big Rapids, MI (US)

(73) Assignee: Judith A. Hooper, Big Rapids, MI (US)

( * ) Notice: Subject to any disclaimer, the term of this patent is extended or adjusted under 35 U.S.C. 154(b) by 235 days.

(21) Appl. No.: 15/613,167

(22) Filed: Jun. 3, 2017

(65) Prior Publication Data

US 2018/0347200 A1 Dec. 6, 2018

(51) Int. Cl.

| | |
|---|---|
| ***E04F 10/04*** | (2006.01) |
| ***E01F 7/02*** | (2006.01) |
| ***G09F 15/00*** | (2006.01) |
| ***E04B 2/74*** | (2006.01) |
| *A47G 5/00* | (2006.01) |

(52) U.S. Cl.

CPC ..... *E04F 10/04* (2013.01); *E01F 7/025* (2013.01); *E04B 2/7433* (2013.01); *G09F 15/0012* (2013.01); *A47G 5/00* (2013.01)

(58) Field of Classification Search

CPC ..... A47G 5/00; E01F 7/025; E04B 2/7416; E04B 2/7433; E04B 2002/7418; E04B 2002/742; E04B 2009/0492; E04F 10/02; E04F 10/04; G09F 15/0012; G09F 15/0018; G09F 15/0037; G09F 15/0056; G09F 2015/0093

USPC ..... 160/179, 237, 351, 371, 378, 383, 385, 160/386, 387, 390

See application file for complete search history.

(56) References Cited

U.S. PATENT DOCUMENTS

| | | | | |
|---|---|---|---|---|
| 3,308,875 | A * | 3/1967 | Abrams | A47H 23/04 160/237 |
| 3,561,518 | A | 2/1971 | Johnson | |
| 4,432,381 | A | 2/1984 | Greenbaum | |
| 4,471,548 | A | 9/1984 | Goudie | |
| 4,516,620 | A | 5/1985 | Mulhern | |
| 4,881,565 | A | 11/1989 | Turk | |
| 5,553,648 | A | 9/1996 | Goharjou | |
| 6,032,684 | A | 3/2000 | Narron | |
| 6,206,079 | B1 | 3/2001 | Selgrad | |
| 6,354,043 | B1 | 3/2002 | Simon et al. | |
| 6,513,566 | B2 | 2/2003 | Larin | |
| 7,841,378 | B2 | 11/2010 | Henning | |
| 7,857,291 | B2 | 12/2010 | Dombrowski | |
| 8,015,738 | B2 | 9/2011 | Ernetoft | |
| 8,104,574 | B1 | 1/2012 | Kellenaers | |
| 8,973,645 | B1 | 3/2015 | Cannova | |
| 9,038,296 | B2 | 5/2015 | Melic | |
| 9,315,985 | B2 | 4/2016 | Gosling et al. | |

(Continued)

*Primary Examiner* — William V Gilbert

(57) ABSTRACT

Disclosed is an outdoor privacy screen for space-dividing residential and commercial landscapes with innovatively, snap fasteners that attach to a rigid horizontal support bar which suspends, for breeze-propelled, independent and not interconnected for motion, a decorative fabric panel that is easily secured, removed, and interchanged by means of sliding the panel's top hem pocket onto and across the bar. The fabric panel bottom edge may overlap an additional panel top edge to form a louver arrangement affording privacy; sunlight mitigation; and, airflow allowance for the creation of a wind resistant privacy partition.

4 Claims, 10 Drawing Sheets

(56) References Cited

U.S. PATENT DOCUMENTS

| | | | | |
|---|---|---|---|---|
| 9,512,670 | B2 | 12/2016 | Forbis et al. | |
| 2015/0136341 | A1* | 5/2015 | Bally | A47G 5/00 160/368.1 |
| 2017/0011671 | A1* | 1/2017 | Goldrich | G09F 15/0031 |

* cited by examiner

PRIVACY SCREEN

FIELD OF THE INVENTION

The present invention relates to privacy screens, more particularly to outdoor, decorative, sunlight mitigating, and wind resistant, panel privacy assemblies for space-dividing both residential and commercial environments.

BACKGROUND OF THE INVENTION

As urban populations grow and the trend for outdoor living becomes a staple for homeowners and renters alike, the need for out-of-doors privacy has never been greater. The U.S. Census Bureau reports that as of 2012, 80.7 percent of the population resided in urban areas. Moreover, while homes have been increasing in size, lots have been decreasing. Similarly, the Apartment and Condominium Construction industry has been experiencing one of the fastest expansions within the construction sector. In their personal landscapes, everywhere, people are in closer proximity to one another and in need of privacy.

Also, there is a trend to bring the indoors, out, by creating outdoor landscapes that are well-designed, comfortable retreats. In 2016, The Institute of Architects reported that the outdoor living market expected to top $7.1 billion by 2020. Consumers desire relaxing, personal spaces with lighting and furnishings, including privacy partitions that decoratively enhance views or, in some cases, screen undesirable vistas.

Important, too, for outdoor living is a means to limit exposure to skin cancer-causing, ultraviolet (UV) rays. Identifying adequate shading devices for outdoor living environments is a concern.

Taking advantage of these outdoor spaces on fair-weather days means that privacy, decorative, and at least partially sun-shielding privacy screens are required to function in breezes and winds that often arise on the sunniest occasions. Outdoor space-dividers need to be wind resistant and stable under such conditions.

There exists, across industries, a variety of devices that include parts addressing the aforementioned needs relative to an effectively functioning outdoor privacy screen. However, no product or disclosure addresses all of these requirements in a single, successful invention.

Prior art discloses outdoor, manually moveable and portable privacy screens, windscreens, and sunshades, among others. Privacy is usually achieved by tensioning one or more, large, flexible i.e., fabric panels to a frame. However, tensioned panels are not wind resistant and in breezy conditions, such screens become unstable. And, recommendations for leg bracing via sandbags or other weights is unwieldy and unattractive. In addition, although large, flexible panels may be removable from their frames, they are costly to replace, difficult to clean, and offer fewer design alternatives than the smaller, easily removable panels of the present invention. U.S. Pat. No. 5,553,648 (Goharjou; Sep. 10, 1996) discloses a portable wall system with flexible sheet half-moon cut flaps. However, wind slits are negligible in wind force abatement.

Fixed, e.g., bolted down, clamped on, etc., outdoor deck partitions and balcony shields exist in prior art. These types rely on the structural integrity of their foundations or supports for stability. Compromised deck flooring or balcony railing inhibits the safe functioning of these types. And, unlike the present invention, fixed types lack mobility to provide light deflection as the sun changes position throughout the day. U.S. Pat. No. 6,513,566 B2 (Larin; Feb. 4, 2003), discloses a balcony railing-affixed shielding device with two flexible panels.

Outdoor, wind-resistant, multi-panel products exist in prior art such as traffic shields and fence products. These barriers are unrelated to the functional privacy the present invention assumes. U.S. Pat. No. 8,973,645 B1 (Cannova; Mar. 10, 2015) discloses a portable wind-resistant traffic screen wherein "The screen partially disengages . . . for the purpose of reducing wind pressure . . . ."

Devices with flexible fabric, louver-arranged panels for permitting airflow, and wind resistance, where the lamellae are not interconnected for motion, exist ranging from windbreakers to insect screens. However, prior art discloses no invention that allows air to pass between flexible-fabric louver-arranged panels ensuring resistance to wind gusts such as the present invention assumes. U.S. Pat. No. 4,432,381 (Greenbaum; Feb. 21, 1984) discloses a windbreaker secured to a frame.

Prior art discloses indoor, space-dividing privacy partitions with flexible frame covers typically designed for venues such as: offices, hotel rooms, and, production facilities. Prior art reveals no invention incorporating both mobility and a decorative mix-and-match, multi-panel function such as the present invention assumes. U.S. Pat. No. 6,354,043 B1 (Simon et. al, Mar. 12, 2002) discloses an office partition of draped fabric panels reliant on a fixed frame.

Prior art reveals inventions incorporating quick-release snap fasteners for attaching flexible sheets to solid substrates in devices such as boat covers and display frames among others. No prior art reveals a quick-release, panel fastening system such as the present invention assumes. U.S. Pat. No. 4,471,548 (Goudie; Sep. 18, 1984) discloses a display frame wherein snap fasteners work in conjunction with stabilizing flat bar (see FIG. 13), but the device is not a privacy screen in character.

The present invention's features are easily distinguishable from these and other devices. None of the above devices, taken either singly or in combination, provides a privacy screen for outdoor, residential and commercial use such as the present invention assumes.

The present invention was developed of tubular aluminum, solid aluminum bar, solid steel foot components, and fabric panels for a free-standing and stable; manually moveable; easily assembled frame incorporating releasably-fastened, frame-attached elements suspending a series of mix-and-match, flexible, louver-arranged panels that afford privacy, mitigation of sunlight, and an allowance for air flow thus creating a wind resistant privacy screen.

OBJECTS OF THE INVENTION

It is the object of the invention that the privacy screen be both for residential and commercial use.

It is another object of the invention that the privacy screen affords stability and wind resistance by incorporating weighted base foot components.

It is another object of the invention that the privacy screen affords stability and wind resistance by arranging fabric panels in an airflow-permitting louver configuration.

It is another object of the invention that the privacy screen is manually moveable and easy to assemble.

It is another object of the invention that the privacy screen affords concealment by fastening and suspending fabric panels in louver arrangement.

It is another object of the invention that the privacy screen mitigates harmful UV sunlight by partially accommodating the changing angle of the light throughout the day by means of screen mobility and ultraviolet-ray protective, fabric panels.

It is another object of the invention that fabric panels for outdoor screen use be constructed of standard outdoor awning or woven PVC coated polyester fabric.

It is another object of the invention that the privacy screen enable decorative function flexibility by incorporating multiple, detachable, interchangeable, and replaceable fabric panels that are easy to maintain and cost effective to replace.

It is another object of the invention that the privacy screen be available with quick-release snap fasteners that secure metal bar held fabric panels to vertical tube members of said structural frame.

It is another object of the invention that the privacy screen be modular by enabling outer edge vertical members of one screen to fit snugly to side-by-side outer edge vertical members of one or more additional screens.

The present invention is a single structure frame with foot components and comprised of: metal tubing, square bar, and plate; bolts; bolt-less right angle connectors; retractable-pin spring-clip fasteners; grip knobs; quick-release snap fasteners; and, frame-detachable metal flat bars that support hanging, flexible fabric privacy panels.

The privacy frame panels are made of non-transparent, ultraviolet-ray protective, solution-dyed acrylic awning or PVC coated polyester mesh fabric. Panel fabrics are easy to clean; and, sun and mildew resistant.

When assembled, the privacy frame is supported by two sets of solid-metal, foot components i.e., a base plate with welded arch and bolted foot post; frame-attached by sliding said post into the lower frame vertical tube bottom end and securing said post, tube, and arch by a hand-tightened grip knob. A second set of foot components is likewise secured to a second vertical tube bottom end. Spring-clip fasteners inserted into lower frame vertical tube upper ends are in turn spring-clip fastened to two longitudinal tube frame member lower ends. Longitudinal frame tubes are thus connected to the lower frame section.

Spring-clip fasteners are then inserted into two longitudinal tube frame member upper ends that in turn spring-clip to upper frame vertical tubes. The rectangular frame with foot components is thus assembled. Five fabric panels are then hem-slid onto five metal flat bars. Each metal flat bar is independently, quick-released fastened to the frame face at regular intervals.

The assembly of the invention is comprised of approximately eight simple steps including base feet assembly, i.e., bolting foot posts to base plates; connecting foot posts and base plate arches to the lower frame section via hand-tightened grip knobs; spring-clip fastening longitudinal side tubes to both the lower and upper frame tube sections; sliding fabric panels over respective metal flat bars; and, quick-release fastening metal flat bars to said frame.

BRIEF DESCRIPTION OF THE DRAWINGS

By way of example, reference will now be made to the accompanying drawings, which are not to scale.

The same reference numbers will be used throughout the drawings and the following description to refer to the same or like parts.

DETAILED DESCRIPTION OF THE INVENTION

A problem in the market exists that there is no outdoor, independently stable, easily moveable, space-dividing residential and commercial privacy screen that offers within a single invention, sunlight mitigation, wind resistance; and, interchangeable, cost effective, decoratively changeable, louver configured, releasably-fastened, flexible panels. The various embodiments of the privacy screen herein are designed for outdoor residential and commercial use. However, the screen may be utilized to accommodate indoor privacy needs as well. For example, in addition to outdoor residential use on patios, decks, and in the landscape, among other locations, the screen may be used indoors to provide privacy within rooms and spaces where division, retreat, or a measure of solitude is desired. Consumers may select among a variety of frame, panel colors, and materials dependent upon preference and application.

Commercially, the privacy screen may be used outdoors in a variety of venues where some measure of separation from others is preferred. Outdoor seating for coffee shops and restaurants are primary examples. Indoor use might include situations where pharmacies arrange client privacy and retail stores provide fitting space partitions. Commercial organizations may incorporate their identities on screen frame panels as well as determine frame and panel colors. In all cases, both out-of-doors and indoors, the privacy screen is designed to be multi-functional, visually pleasing, high quality, and of moderate cost to consumers.

Figure 1:
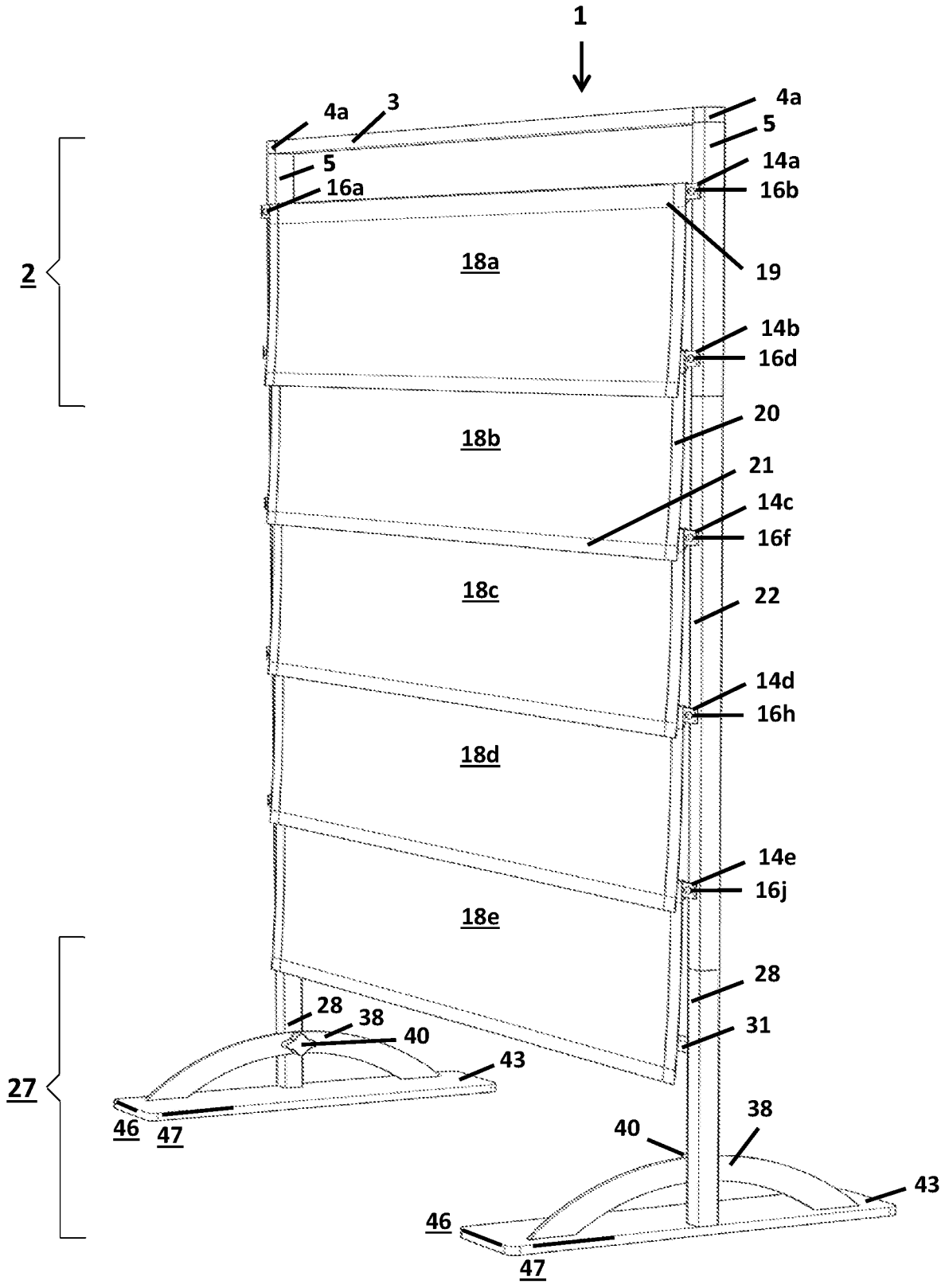
FIG. 1 depicts a front overview diagram of the invention assembled with fabric panels attached.

FIG. 1 is a conceptual embodiment of the best mode for carrying out the privacy screen invention comprised of a rectangular frame 1 with grip knob 40 secured foot components, i.e., base plate 43 with bolt-connected foot post 35 and weld-attached arch plate 38; and, five, fabric panels 18 individually suspended on elongated horizontal metal flat bars 14 mounted with cap and post (female) 16 and socket (female) 17 snap fastener components that fasten to the top frame vertical tubes 5 and longitudinal side tubes 22 screw stud (male) 7 mounted snap fastener components, such that each fabric panel 18 is frame suspended at regular intervals, one beneath the other in a slight, bottom-hem-edge 21 overlapping configuration to create a louver arrangement, where the panels 18 are not interconnected for motion, thus affording a blind configuration for privacy, mitigation of sunlight, and an allowance for air flow that enables a wind resistant privacy screen.

The privacy screen in the illustrated embodiment is modular in function as left top frame vertical tube 5 and left longitudinal side tube 22 and the left planar foot base plate 43 outside edges form a single vertical plane that allows two or more screens to snugly align when placed in a side-by-side configuration. In this embodiment, the frame with foot components can be up to 7 feet in height and up to 5 feet in width although these embodiments may be increased or decreased dependent upon the functionality desired.

With the above described structure, the left and right side frame tubes, connectors, foot components, horizontal flat bars, snap fastener components, and fabric panels are identical one to the other. However, with frame assembly, the two right angle connectors 4 and, the two sets of foot components, i.e., base plate 43 with bolt-connected foot post 35 and weld-attached arch plate 38 are grip knob 40 secured to the frame in mirror image of one to the other. In addition, although the left side frame tubes, connectors, foot components, topmost frame attached flat bar, snap fastener components, and fabric panel thereof will be described below, it is understood that the description to follow is equally applicable to the connection of the right side frame tubes, connectors, foot components, and all other frame attached flat bars, snap fastener components, and fabric panels.

Figure 2:
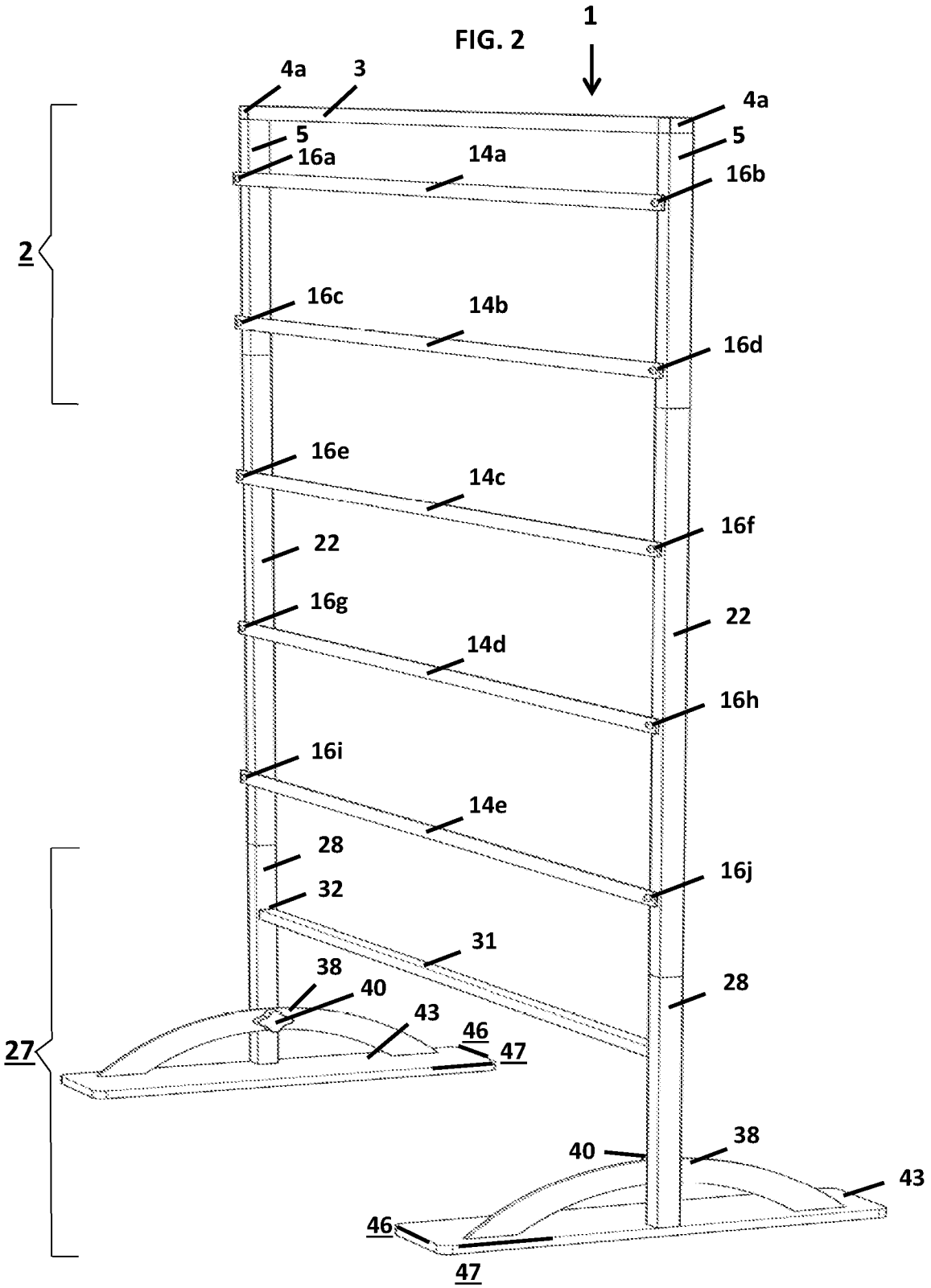
FIG. 2 depicts a front view and conceptual embodiment of the invention assembled with snap detachable horizontal flat bars with cap and post (female) snap fastener components visible.

FIG. 2 depicts a front view and conceptual embodiment of the invention assembled with snap detachable 1" W by 44" L by ⅛" thick horizontal flat bars 14 with cap and post (female) 16 snap fastener components visible; and, wherein five said bars 14 are frame snap fastened; and, wherein two said bars 14*a* and 14*b* fasten to the frame top section 2 vertical tubes 5 at approximately 4" and 15" down from the top frame horizontal tube 3 top edge, and three said bars 14*c*, 14*d*, and 14*e* fasten to the longitudinal side tubes 22 at approximately 27", 39" and 51" down from the top frame horizontal tube 3 top edge.

Figure 3:
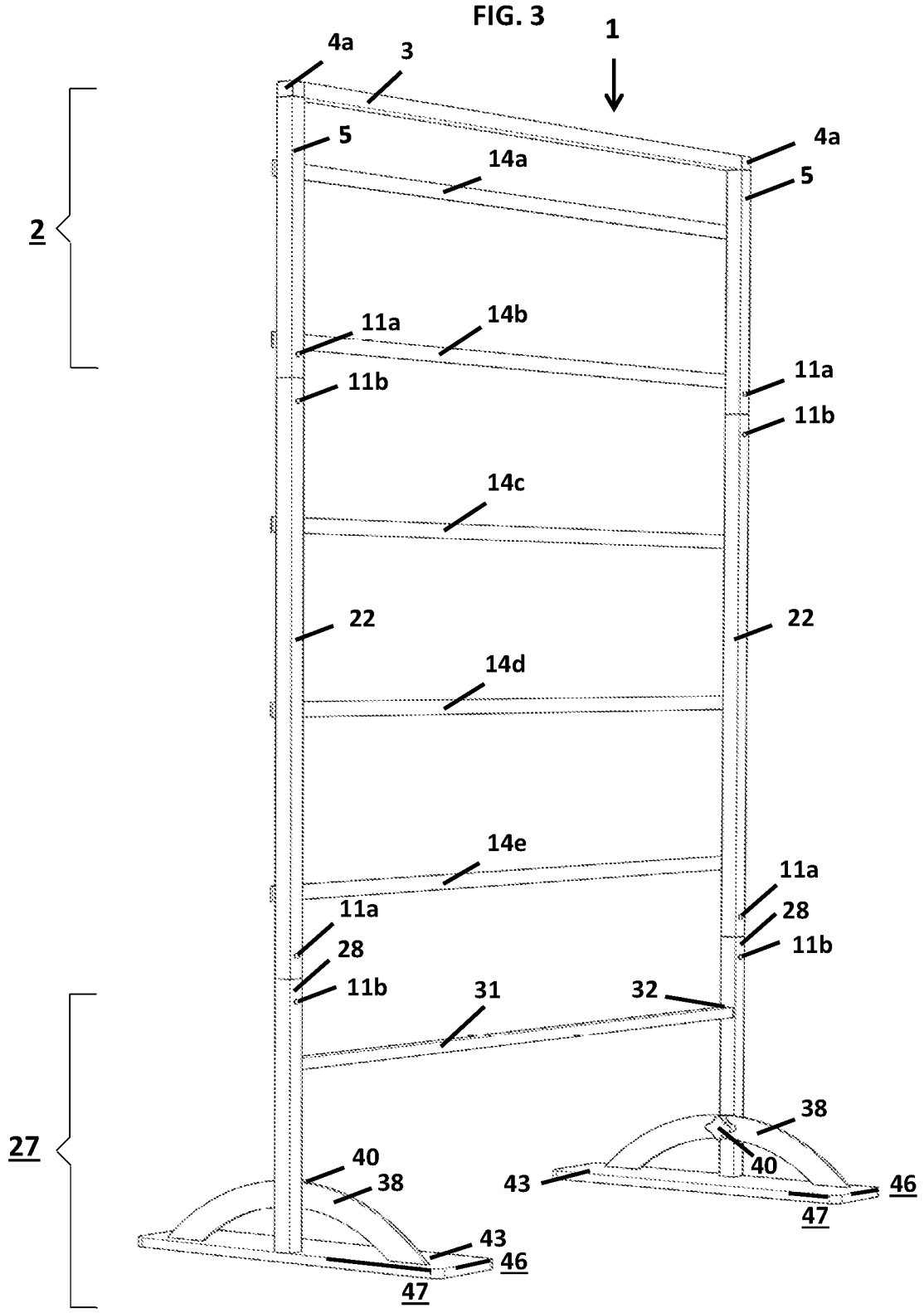
FIG. 3 depicts a rear view and conceptual embodiment of the invention assembled with spring-clip fastener buttons visible.

FIG. 3 depicts a rear view and conceptual embodiment of the invention assembled with spring-clip fastener 10 retractable spring buttons 11*a* and 11*b* visible.

Figure 4:
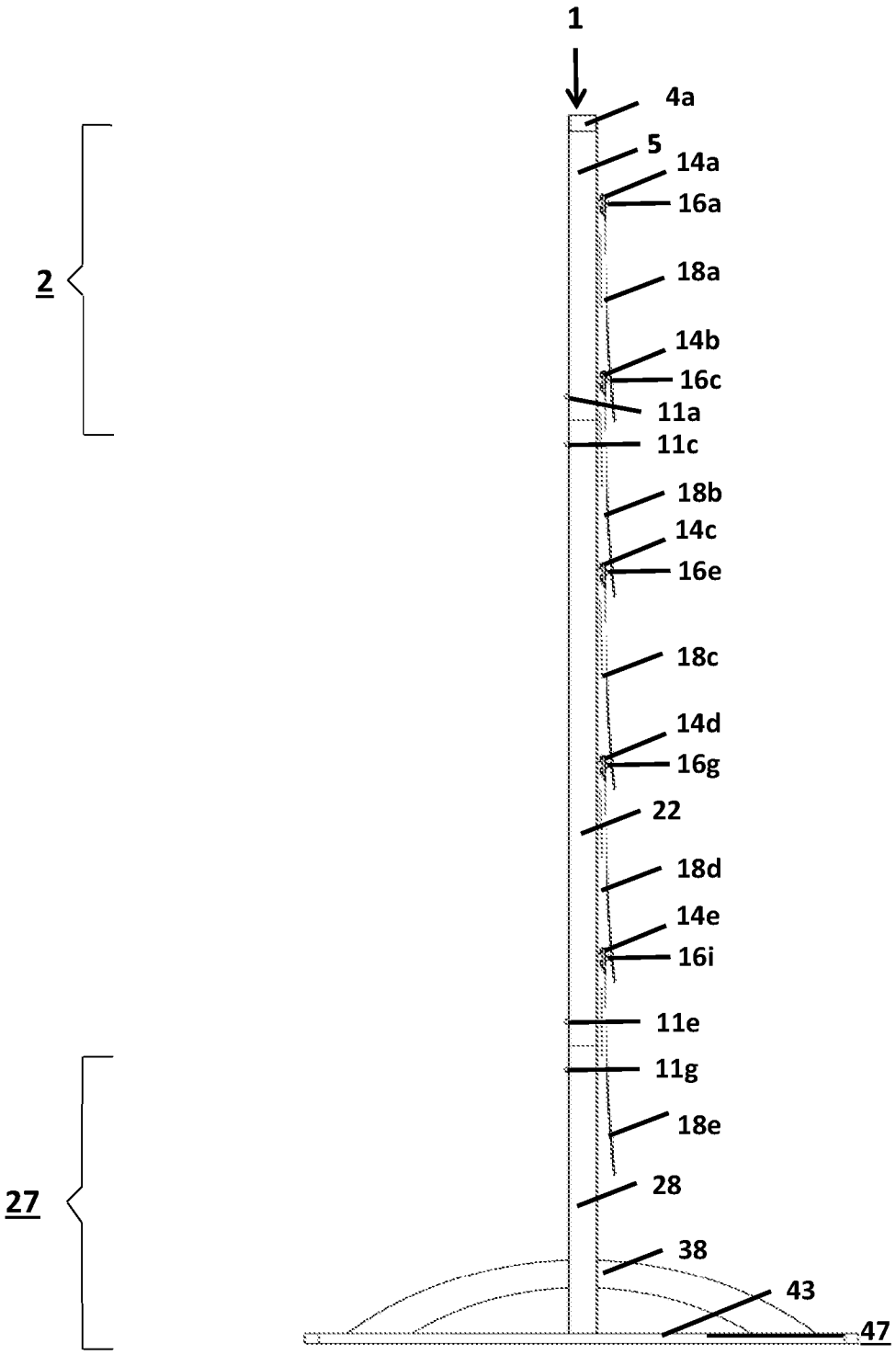
FIG. 4 depicts a side view and conceptual embodiment of the invention assembled with fabric panels attached.

FIG. 4 depicts a side view and conceptual embodiment of the invention assembled with fabric panels 18 attached.

Figure 5:
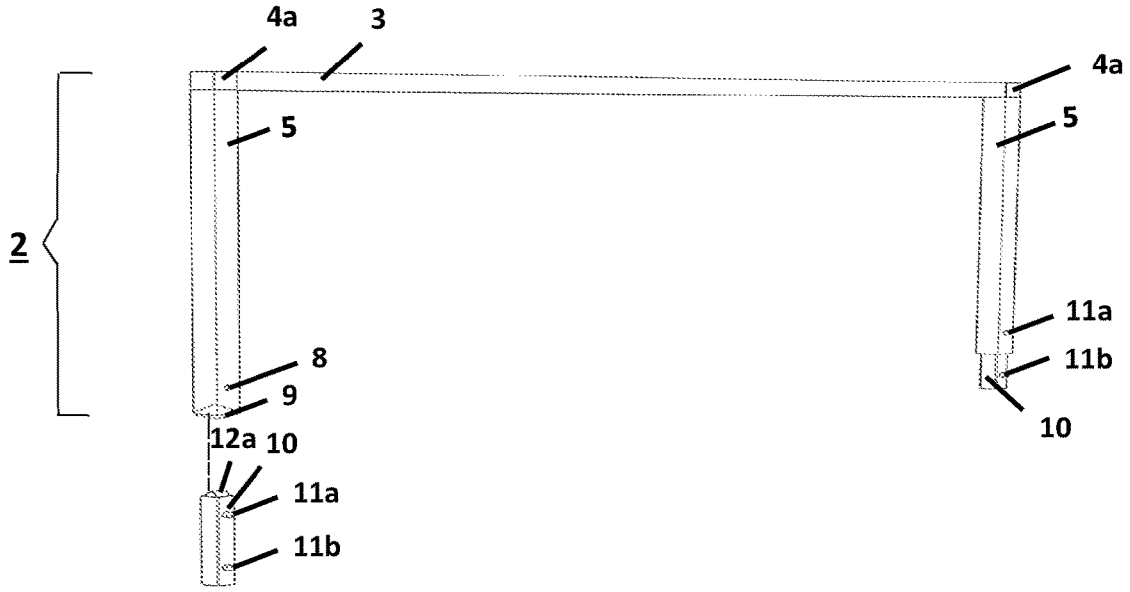
FIG. 5 depicts a rear view and conceptual embodiment of the frame top section, with right angle connectors, spring-clip fasteners, vertical tube hole to accept spring-clip fastener retractable spring button, and spring-clip fastener inserted.

FIG. 5 depicts a rear view and conceptual embodiment of the frame top section 2 with mirror-image right angle connectors 4, spring-clip fasteners 10, left vertical tube hole 8 to accept spring-clip fastener 10 retractable spring button 11*a*; and, spring-clip fastener 10 inserted with retractable spring button 11*a* protruding through said right vertical tube 5; and, wherein a non-limiting example is, the frame top section 2 is constructed of three sections of 1"×1" square hollow metal tubing, i.e., one horizontal tube 3, approximately 42" long; and, an identical left and right vertical tube 5, approximately 17½" high; and, said tubes to receive a left and right ninety-degree, a non-limiting example is, 1" square profile, bolt-less, rigid nylon, right angle connector 4 with square corner endpoint 4*b* visible thus forming a right angle frame top section 2 of two, mirror image right angle connectors 4; and, wherein the rear face of each vertical tube 5 is identically modified by a single hole 8 drilled center space from left to right side on said tube 5 rear face, at approximately one inch from said tube 5 bottom open end 9, to accept a spring-clip fastener 10 retractable spring button 11*a*.

Figure 6:
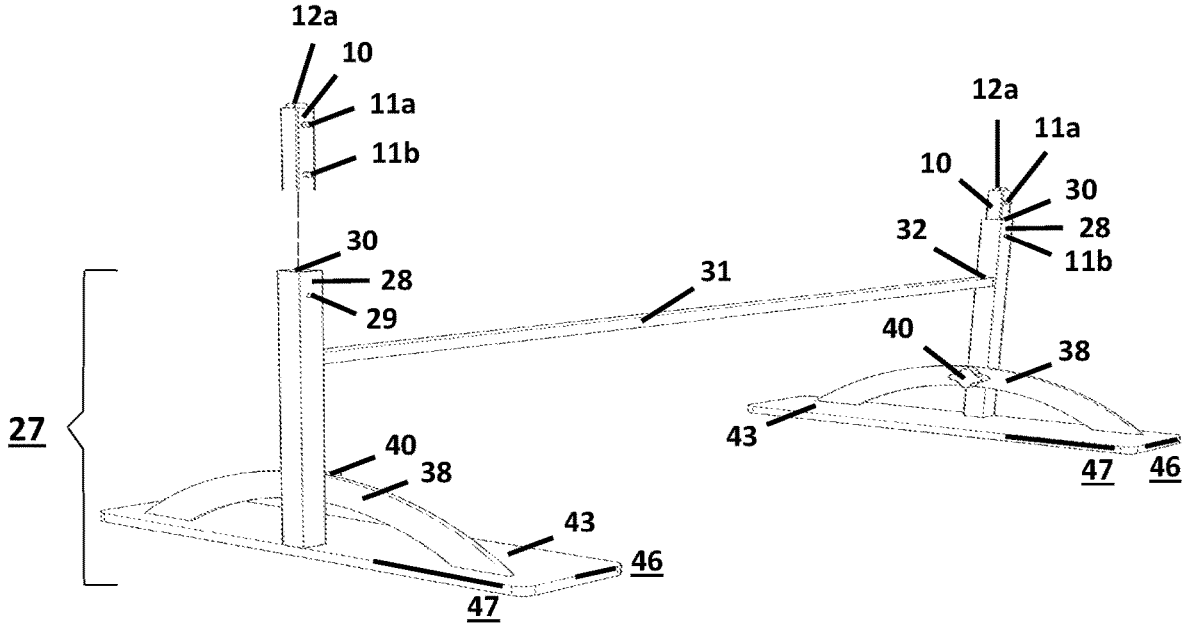
FIG. 6 depicts a rear view and conceptual embodiment of the frame bottom section, spring-clip fasteners, vertical tube hole to accept spring-clip fastener retractable spring button, and spring-clip fastener inserted.

FIG. 6 depicts a rear view and is a conceptual embodiment of the frame bottom section 27, spring-clip fasteners 10, and left vertical tube hole 29 to accept spring-clip fastener 10 retractable spring button 11*b*, and spring-clip fastener 10 inserted with retractable spring button 11*b* protruding through said right vertical tube 28; and, wherein a non-limiting example is, the frame bottom section 27 is constructed of two sections of 1"×1" square hollow metal tubing, i.e., an identical left and right vertical tube 28, approximately 17½" high, welded at right and left vertical tube 28 inside face plane center points 32, approximately twelve inches from said tube bottom ends, to a ¾" diameter square solid aluminum horizontal cross bar member 31, approximately 42" long, and wherein the rear face of each bottom frame vertical tube 28 is identically modified by a single hole 29 drilled center space from left to right edge on said tube 28 rear face plane, at approximately one inch from said tube top end 30 to accept a spring-clip fastener 10 retractable spring button 11*b*.

Figure 7:
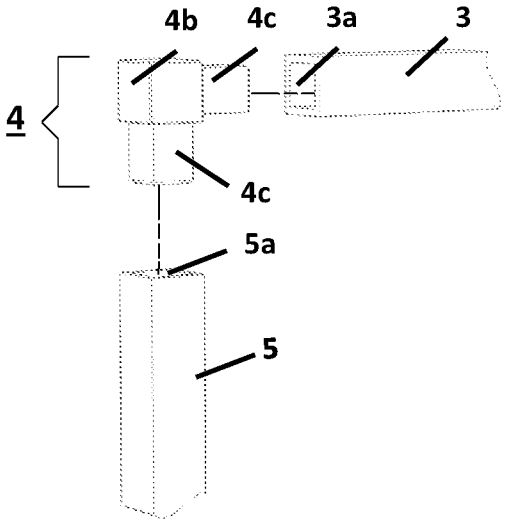
FIG. 7 depicts a close-up of a bolt-less, right angle connector, horizontal tube open end and vertical tube top open end to accept right angle connector angles.

FIG. 7 depicts a close-up of a bolt-less, right angle connector 4, horizontal tube 3 open end 3*a* and vertical tube 5 top open end 5*a* to accept said connector right angles 4*c*; and, wherein a non-limiting example is a left rigid nylon, bolt-less right angle connector 4, with 1" diameter square corner endpoint 4*b* visible upon frame assembly; and, wherein one of two adjacent right angles 4*c* is inserted into left horizontal tube 3 open end 3*a* and the second of two said angles is inserted into left vertical tube 5 left top open end 5*a*; thus forming the frame top section left right angle corner.

Figure 8:
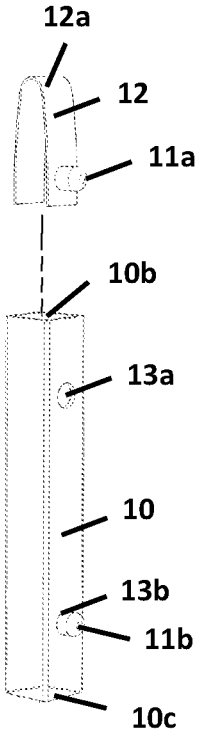
FIG. 8 depicts a close-up of a spring-clip fastener.

FIG. 8 depicts a close-up of a spring-clip fastener 10; and, wherein a non-limiting example is, said fastener 10 is constructed of an approximately ¾" square hollow, zinc-plated, steel tube approximately 5" in length; and, wherein said fastener 10 is identically modified by two single holes 13*a* and 13*b* drilled center space from left to right edge on said fastener 10 rear face plane and at one inch from each said fastener 10 end to accept said fastener 10 retractable spring pin button 11*a* and retractable spring pin button 11*b*; and, wherein said fastener top open end 10*b* is inserted with two identical spring pins 12 by sliding a first said spring pin 12 spring pin button 11*b* end into said fastener 10; and, wherein the first inserted spring pin 12 retractable spring pin button 11*b* protrudes from said fastener 10 rear face hole 13*b*, and sliding a second said spring pin 12 spring pin button 11*a* end into said fastener 10; and, wherein the second inserted spring pin 12 retractable spring button 11*a* protrudes from a second said fastener 10 rear face hole 13*a*; and, wherein the second spring pin 12 hoop end 12*a* of the second inserted retractable spring pin button 11*a* remains protruding from said fastener 10 top open end 10*b*. Four, identical, spring-clip fasteners 10 are utilized in frame assembly.

Figure 9:
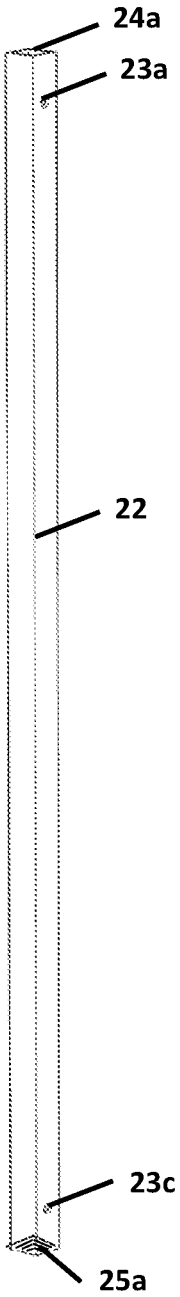
FIG. 9 depicts a rear view and is a conceptual embodiment of the longitudinal side tube, tube top and bottom open ends, and tube rear holes to accept spring-clip fastener retractable spring buttons.

FIG. 9 depicts a rear view and is a conceptual embodiment of the left longitudinal side tube 22; tube top 24*a* and bottom 25*a* open ends; and, tube top rear 23*a* and bottom rear 23*c* holes to accept spring-clip fastener 10 retractable spring-pin buttons 11*a* and 11*b*; and, wherein a non-limiting example is, a left said tube 22, is constructed of 1"×1" square hollow metal tubing, approximately 39" in length, top open end 24*a* and bottom open end and color-coded at said bottom inside open end 25*a* to ensure correct said tube-to-frame assembly orientation; and, wherein the rear face of said tube 22 is identically modified by single holes 23*a* and 23*c* drilled center space from left to right edge on said tube 22 rear face, at one inch from each said tube 22 ends 23*a* and 23*c*, to accept said spring-clip fastener 10 retractable spring-pin buttons 11*a* and 11*b*.

Figure 10:
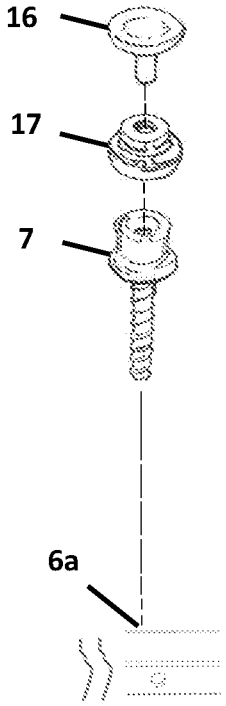
FIG. 10 depicts a close-up of snap fastener components, i.e. cap and post (female) and socket (female); and, screw stud (male) and tube with front face hole for inserting screw stud (male) 7 snap fastener.

FIG. 10 depicts a close-up of snap fastener components, i.e. cap and post (female) with socket (female); and, screw stud (male) and tube with front face hole for inserting screw stud (male) 7 snap fastener.

Figure 11:
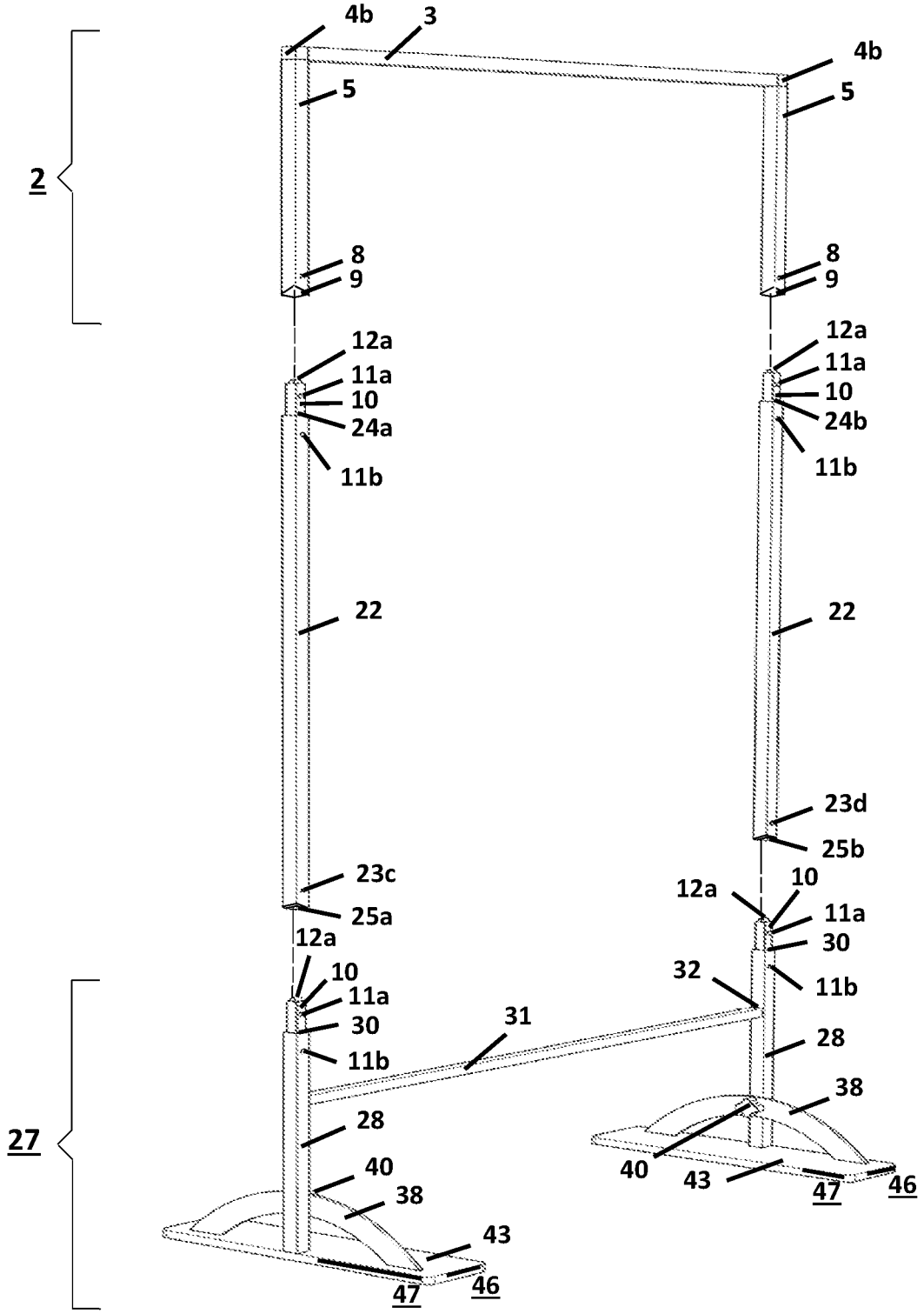
FIG. 11 depicts a rear view and is a conceptual embodiment of the frame top section, longitudinal side tubes, and frame bottom section with spring-clip fastener frame assembly means.

FIG. 11 depicts a rear view and is a conceptual embodiment of the frame top section 2, longitudinal side tubes 22, and frame bottom section 27 with spring-clip fastener 10 frame assembly means; and, wherein for connecting the left longitudinal tube 22 to the left top frame vertical tube 5, a non-limiting example is, a spring-clip fastener's 10 non hoop open end 10*c* is inserted into the left longitudinal side tube 22 upright top open end 24*a* such that retractable spring button 11*b* protrudes from longitudinal side tube 22 rear face hole 23*a* (FIG. 9); and, wherein said spring-clip fastener 10 hoop end 12*a* is inserted into the left top frame vertical tube 5 open end 9 such that the spring-clip fastener 10 retractable spring button 11*a* protrudes from the left top frame vertical tube 5 rear face hole 8 thus securing the left longitudinal side tube 22 to the left top frame vertical tube 5; and, wherein, for connecting the left longitudinal tube 22, to the bottom left frame vertical tube 28, a non-limiting example is, the next spring-clip fastener 10 spring-pin non hoop open end 10*c* is inserted into the left bottom frame vertical tube 28 upright open end 30 such that the spring-clip fastener 10 retractable spring button 11*b* protrudes from the bottom frame vertical tube 28 rear face hole 29; and, wherein said spring-clip fastener 10 hoop end 12*a* is inserted into the left longitudinal side tube color-coded bottom open end 25*a* such that the spring-clip fastener 10 retractable spring button 11*a* protrudes from the left longitudinal side tube 22 rear face hole 23*c* (FIG. 9) and thus securing the left longitudinal side tube 22 to the left bottom frame vertical tube 28. The assembled frame is held in an upright position by foot components described below.

Figure 12:
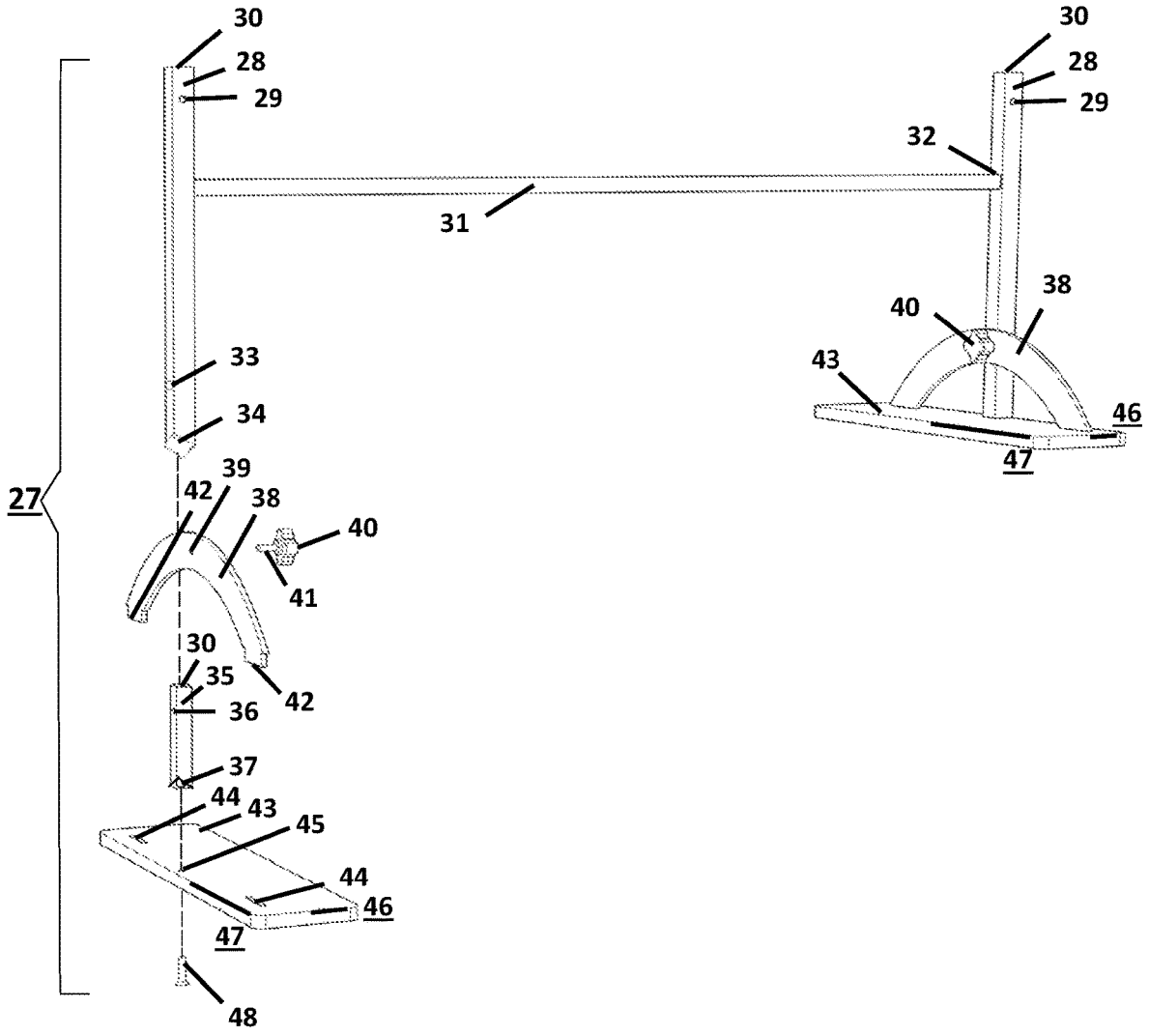
FIG. 12 depicts a front view and is a conceptual embodiment of the frame bottom section and foot components with foot components assembly and connection to frame bottom section means.

FIG. 12 depicts a front view and is a conceptual embodiment of the frame bottom section 27 and foot components, i.e., base plate 43 with bolt-connected foot post 35 and weld-attached planar arch plate 38; and, foot components assembly and connection to frame bottom section 27 means; and, wherein, a non-limiting example is, a left approximately 4½" W by 21½" L by ⅝" thick, essentially rectangular, solid steel foot base plate 43, hole drilled with two approximately 1¾" L by 3/16" W by ⅜" D elongated slots 44 placed with said 3/16" W slot outside edge beginning at approximately 2" from said plate width edge 46 and said 1¾" L slot outside edge beginning at approximately 1" from said plate longitudinal edge 47; and, wherein a left approximately 18½" L by 2" W by 3/16" thick, 6" mid-point high, curved steel planar arch plate 38 with two, 1½" wide, right angle ends 42; and, wherein each said arch end 42 is inserted into each said slot 44 and spot welded on the inside bottom of said slot 44 thus permanently connecting said base plate 43 to said arch 38 at a ninety-degree angle to one another; and, wherein said arch 38 is single hole drilled at center space from left to right on said arch 2" W face plane edges, and at center mid-point 39 from each said arch end 42; and, wherein said left base plate 43 is also single hole drilled at approximately ½" to the right of said plate 43 longitudinal midpoint 45 and longitudinal outer face edge 47; and, wherein a ¾" diameter, square solid steel left foot post 35 approximately 5¾" high, single hole drilled on its inside face plane 36 and at approximately 5" from said post bottom end 37 to a depth of approximately ½"; and, wherein said post 35 is also single hole drilled on its bottom face center point 37 to a depth of approximately ⅜"; and, wherein said post 35 is secured to a left base plate 43 by aligning said post bottom face center point hole 37 with said base plate 43 hole 45 and by positioning said foot post 35 outside face plane parallel with said base plate 43 longitudinal edge 47 and by inserting a 5/16" diameter hex bolt 48 up through the bottom of the left foot base plate 43 hole 45 and into the left vertical foot post 35 bottom center face hole 37 and allen-wrench tightening said bolt 48 thus securing the left foot plate 43 to the left foot post 35, in a ninety-degree relation to one another, such that said post 35 may be placed in a vertically upright position; and, wherein to secure the left bottom frame vertical tube 28 to left foot components, a non-limiting example is, a left bottom frame vertical tube open bottom end 34 is slid over and onto a left foot post 35 vertically upright end 30 thus aligning the bottom frame vertical tube 28 inside face hole 33; foot post 35 inside face hole 36; and, planar arch plate 38 hole 39; and, wherein a 1¾" diameter grip knob 40 with an approximately 5/16" diameter 18 thread, and approximately ½" long screw thread 41 is inserted through the planar arch plate 38 hole 39; bottom frame vertical tube 28 hole 33 and into the aligned foot post 35 hole 36 such that said bottom left frame vertical tube 28 is connected to left foot components, i.e., base plate 43 with bolt-connected foot post 35 and weld-attached planar arch plate 38.

Figure 13:
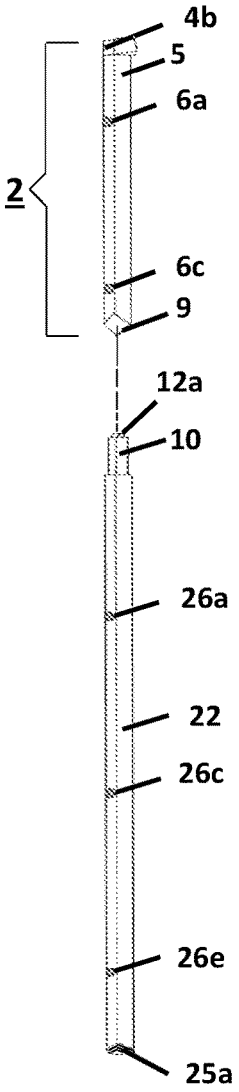
FIG. 13 depicts a front view and is a conceptual embodiment of the frame top section right angle connector, vertical tube, and longitudinal side tube with frame top section vertical tube and longitudinal front face tube holes for inserting screw stud (male) snap fastener components.

FIG. 13 depicts a front view and is a conceptual embodiment of the frame top section left side, right angle connector 4, left vertical tube 5, and left longitudinal side tube 22 with said vertical tube 5 front face tube holes 6*a* and 6*c*, and said longitudinal tube 22 front face tube holes 26*a*, 26*c*, and 26*e* for inserting screw stud (male) 7 snap fastener components; and, wherein, a non-limiting example is said vertical tube 5 front face is modified by a single hole drilled 6*a* at 4½" down from the top-of-frame outside edge and 6*c* at 15½" down from said edge, and said longitudinal side tube 22 front face is modified by a single hole drilled 26*a* at 27½", 26*c* at 39½", and 26*e* at 51½" down from said edge; and, wherein vertical tube 5 holes 6*a* and 6*c*; and, longitudinal tube 22 holes 26*a*, 26*c*, and 26*e* are center spaced from left to right edge on said vertical tube 5 and said longitudinal tube 22 front face planes and left said holes 26*a*, 6*c*, 26*a*, 26*c*, and 26*e* are also spaced in vertically equidistant relation one to the other.

Figure 14:
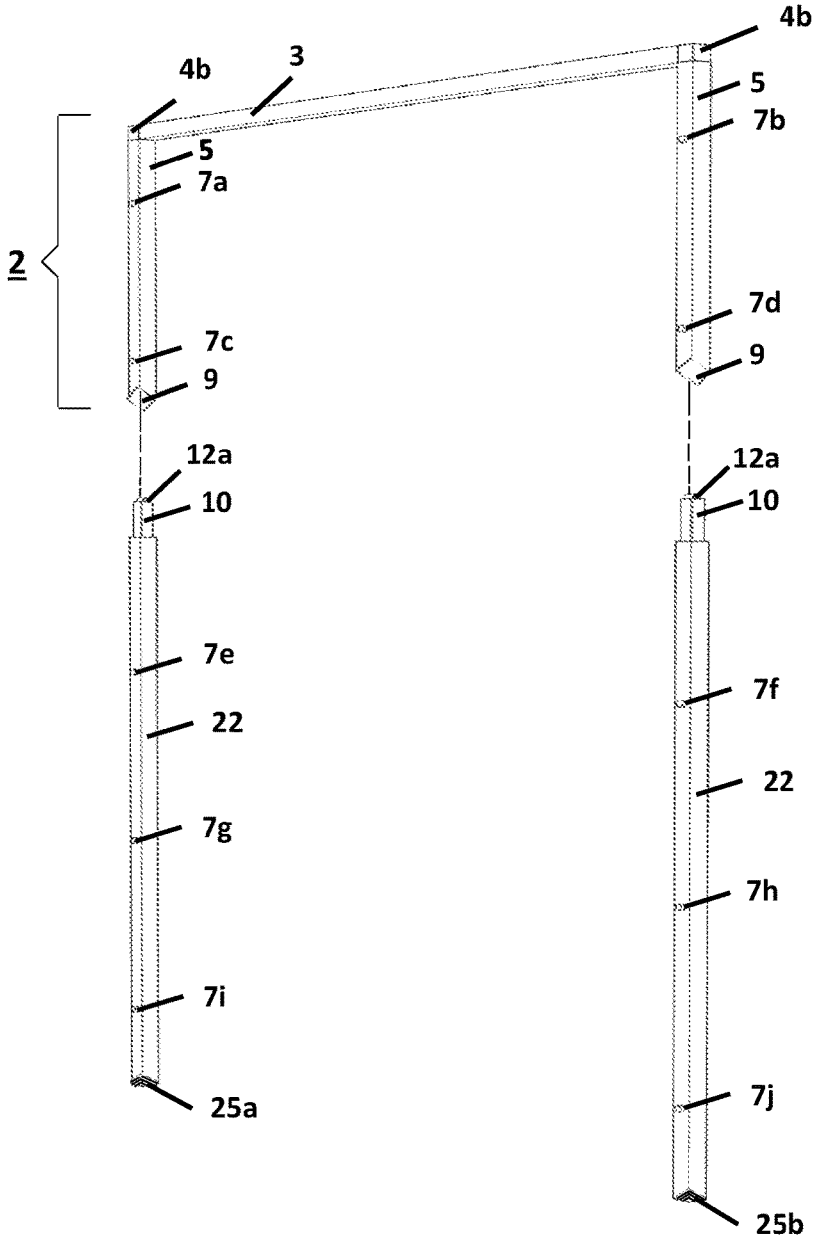
FIG. 14 depicts a front view and is a conceptual embodiment of the frame top section and longitudinal side tubes with screw stud (male) snap fastener components attached.

FIG. 14 depicts a front view and is a conceptual embodiment of the frame top section 2; and, vertical side tubes 5 and longitudinal side tubes 22 with screw stud (male) 7 snap fastener components attached; and, wherein a non-limiting example is for permanent mounting by screwing in a heavy duty, stainless, self-tapping #10 7/16" screw stud 7 is used; and, whereby left vertical tube hole 6*a* and 6*c* is inserted respectively with corresponding said studs 7*a*, 7*c*; and, left longitudinal tube hole 26*a*, 26*c*, and 26*e* is inserted respectively with corresponding said studs 7*e*, 7*g*, and 7*i*; and, wherein each stud is center spaced from left to right on said vertical tube 5 and said longitudinal tube 21 front face planes and all said left studs are mounted in vertically equidistant relation to one another on said vertical 5 and longitudinal 21 tube front face planes.

Figure 15:
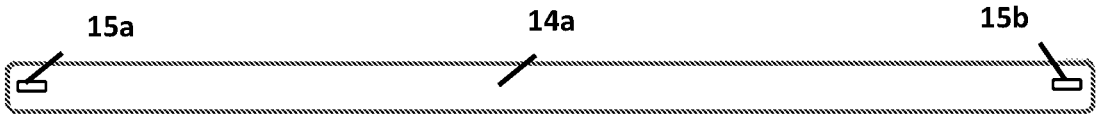
FIG. 15 depicts a front view and is a conceptual embodiment of the horizontal metal flat bar with two elongated slots to accept cap and post (female) and socket (female) snap fastener components.

FIG. 15 depicts a front view and is a conceptual embodiment of the topmost horizontal metal flat bar 14*a* drilled with two elongated slots 15*a* and 15*b* to accept cap and post (female) 16*a* and 16*b*, and socket (female) 17*a* and 17*b* snap fastener components sets; and, wherein a non-limiting example is a rigid horizontal metal flat bar 14*a*, weighing approximately 1.3 lbs., and approximately 1" wide×44" long×⅛" thick is modified by a single hole drilled at approximately ½" from each said bar 14*a* end and at center space from said bar 14*a* top and bottom edges 15*a* and 15*b* for the creation of two 11/64" elongated slots 15*a* and 15*b*; and, wherein insert through said slots 15*a* and 15*b* of said bar 14*a* front face plane, 24/cap, 5/16" brass nickel plate said posts 16*a* and 16*b*; and, by the use of a snap fastener tool, permanently join each said post 16*a* and 16*b* to a corresponding hard action brass nickel plate socket 17*a* and 17*b* placed on said bar 14*a* rear face plane bar slots 15*a* and 15*b*; and, wherein to fasten said posts 15*a* and 15*b* to said sockets 16*a* and 16*b* at such a pressure to create certain slight lateral movement of said cap and post (female) 16*a* and 16*b*, and correspondingly joined socket (female) 17*a* and 17*b* snap fastener components.

Figure 16:
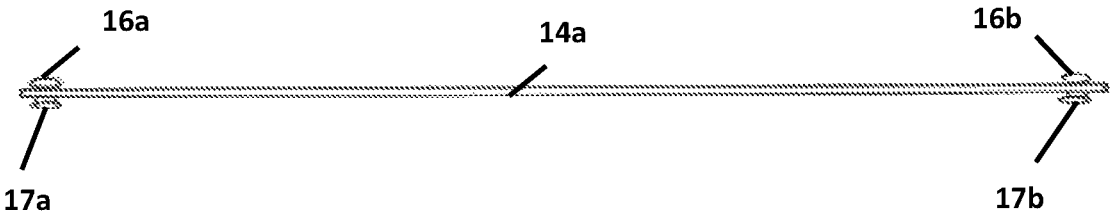
FIG. 16 depicts a top view and is a conceptual embodiment of the horizontal metal flat bar with cap and post (female) and socket (female) snap fastener components attached.

FIG. 16 depicts a top down or "birds-eye" view and is a conceptual embodiment of the topmost horizontal metal flat bar 14*a* with cap and post (female) 16*a* and 16*b* and socket (female) 17*a* and 17*b* snap fastener components sets attached; and, wherein said bar 14*a* is quick release frame attached by aligning said socket (female) 17*a* and 17*b* snap fasteners with corresponding screw stud (male) snap fastener components 7*a* and 7*b*; and, wherein hand pressure is applied to said caps 16*a* and 16*b*; and, wherein said sockets 17*a* and 17*b* are thus interlocked with said studs 7*a* and 7*b* for said bar 14*a* stability and quick frame release.

Figure 17:
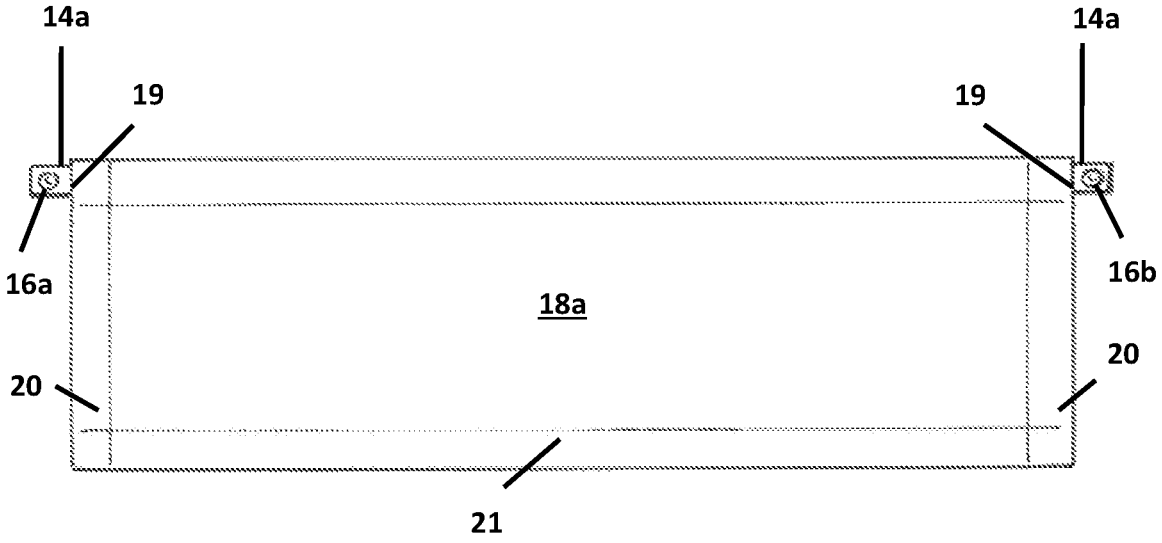
FIG. 17 depicts a front view and is a conceptual embodiment of the fabric panel slid onto a horizontal metal flat bar.

FIG. 17 depicts a front view and is a conceptual embodiment of the topmost fabric panel 18*a* slid onto horizontal metal flat bar 14*a*; and, wherein a non-limiting example is, a fabric panel 18*a* approximately 42" wide and 12" high modified to include an elongated horizontal open pocket top hem 19, two perpendicular vertical side hems 20, and an elongated horizontal bottom hem 21 is fastened to the topmost horizontal metal flat bar 14*a* by sliding the elongated horizontal open pocket top hem 19 onto said bar 14*a*; and, wherein fabric panel 18*a* is frame-held in place; and, wherein each said panel being hung is at regular, horizontal flat bar 14 and snap-fastener controlled intervals, one below the other, independent and not interconnected for movement, and with bottom hems 21 in slight overlap for louver configuration and breeze-propelled motion; and, wherein a non-limiting example is, flexible panels 18 are made of ultraviolet-ray protective, solution-dyed acrylic awning fabric or a PVC coated polyester mesh fabric. Panel fabrics are easy to clean with a mild soap and water; and, are sun and mildew resistant.

Construction

Various embodiments of the privacy screen may be constructed of a lightweight rigid frame with flexible panel material. For example, in some embodiments, the frame may be constructed of 1½"×1½" or 2"×2" hollow aluminum tubing, 1"×1", 1½"×1½" or 2"×2" hollow steel tubing; solid aluminum, steel, or polycarbonate bar; or, wood, among others. Frame finishes may be embodied as anodized and powder coated; and, textured or smooth among others. Frame color may be embodied across the full range of industrial offerings as well as colors uniquely created for the invention herein. In some embodiments, the height and width of the frame may vary per the specific residential, commercial, outdoor, or indoor application. Likewise, horizontal, flat bar supports may vary in length, width, or thickness to accommodate specific applications. For example, aluminum, polycarbonate, acrylic, steel, and wood bars are among the embodied materials that may secure flexible panels to the frame. Flat bar supports may also embody varied finishes and colors in the same manner as the frame. Frame top section right angle connectors may be also be embodied as various colors and types including spring-clip, bolt, or rivet, among others. Likewise, right angle connector material may be nylon, plastic, aluminum, steel, or composite materials. Frame tube spring-clip fasteners may be embodied as zinc-plated steel, aluminum, or a combination of nylon and zinc-plated steel, among other materials. Said frame tube fasteners may also vary in type and be embodied as hinged or telescoping among others.

Further, privacy screen flexible panel embodiments forming a louver configuration may be constructed of any size or shape. Embodiments including various numbers of panels on a frame; and or, the length, width or height of panels may vary per application. Panels may be horizontal bar attached by open pocket hem-sliding onto said bars, but also by such other means, but not limited to, folding a panel top hem edge over said bar and securing said panel with hook and loop fastening tape; snap fasteners; magnets; grommets; and, buttons; or other such embodiments that allow the panel to be easily disengaged from its support bar. In another embodiment, a narrow, approximately ¾" wide by 42" long, lightweight, polycarbonate strip, or other type of stiffening material affording "ballast" may be inserted into a flexible fabric panel horizontal open pocket bottom hem as a means to provide a measure of panel strengthening and or rigidity.

Panels of different colors, shapes, designs, and various straight and scallop edges among others, may be constructed. Die cutouts within panels may be embodied. Double layer panels of different materials, the same materials, intact or cutout to reveal one material behind the other are among the possible embodiments. Panel material may be opaque, translucent or in some circumstances and to a degree, transparent. Panels may be printed on a single side or both sides.

Likewise, in some outdoor privacy frame panel embodiments flexible fabrics may include, but are not limited to, printed acrylics, acrylic-coated polyesters, cotton-polyester blends, vinyl-coated synthetic fiber mesh, olefin, and, canvas e.g., cotton, linen, polyester, acrylics and blends of these materials; and, coated, woven polyester, back-lit textiles among possible types. Similarly, indoor privacy screen flexible materials embodiments may consist of a variety of standard drapery or upholstery fabrics that comply with U.S. government textile industry safety standards and regulations for indoor fabric applications. Panel weights and thicknesses may vary as well. Frame and panels may be enhanced with a wide range of embellishment and trim embodiments. For example, fabric, metal, plastic and wood ornamentations and trims may be applied to any part of the frame, foot base assembly, panel support, or panel itself.

Privacy screen fasteners that secure metal bar held fabric panels to the longitudinal frame members, i.e., quick-release snap fastener components in the present embodiment, may vary to include, but are not limited to, other quick release types such as magnetic; turn; rivet; and, hook and loop fasteners. Various, but not limited to, non-quick release type fasteners may also be embodied such as rivets, bolts, and screws.

The solid steel planar foot base plate, foot base arch, and foot post component material, weights, dimensions, and shapes, embodied in the present invention, are designed to support the frame depicted herein. Alternate material, weight, dimension, and shape embodiments may be assumed given changes in the privacy screen i.e., frame or panel dimensions, and or materials, and or applications. Possible foot component embodiments may include a foot base plate, foot base arch, and foot post constructed of, but not limited to, a polycarbonate or similar material that is molded for a hollow interior that may be filled with material such as, but not limited to, sand or water.

Other foot base plate, foot base arch, and foot post component embodiments may include a range of designs, including but not limited to, foot base plate perforations that enable securing to a foundation, and; base plate and arch raised embossments, or die cutouts any of which provide decoration and or identification, may be embodied. Foot base plate, foot base arch, and post finishes may also be embodied as anodized, powder coated, textured, and smooth, among others. Colors may be embodied across the full range of industrial offerings as well as colors uniquely created for the invention and its various exemplary embodiments herein.

The outdoor privacy screen functions efficiently indoors, both residentially and commercially. For indoor applications, substitution of the foot components of the present invention, for a lighter-weight planar foot base plate, foot base arch, and or foot post with or without foot base plate and or arch perforations, raised embossments, or die cutouts are examples of alternative embodiments.

Finally, the grip knob with screw thread of the present invention, for securing privacy screen foot posts to the frame, may also be embodied in a variety of shapes, sizes, colors, and materials.

Although the above description contains many specifics and embodiments, including those depicted in the accompanying figures, such embodiments merely illustrate and are not restrictive to the broad, present invention, and this invention is not limited to those specific constructions and displays given that those skilled in the art may employ various other modifications within the scope of the following Claims.

The invention claimed is:

1. A privacy structure comprising:

a panel privacy assembly, whereby said panel privacy assembly comprises a rigid flat bar having a first end portion and a second end portion opposite said first end portion, said rigid flat bar having a first slot at said first end portion and a second slot at said second end portion; each said slot having a cap-and-post on a first side of a respective said slot connected to a socket on a second side of a respective said slot, said second side of said respective said slot being opposite said first side of said respective said slot;

a panel made of a flexible fabric material and having a top hem forming a pocket, whereby said pocket receives said rigid flat bar, whereby said first end portion and said second end portion extend beyond a perimeter of said panel;

said privacy structure further comprising a frame comprising a first square side tube and a second square side tube parallel to said first square side tube, each said square side tube having a screw stud attached thereto, each said screw stud receiving a respective said socket in an interlocking relationship, wherein respective said sockets are releasably connected to respective said screw studs.

2. The privacy structure of claim 1, wherein respective said slots permit lateral movement of respective said cap-and-posts and said sockets.

3. The privacy structure of claim 1, wherein said flexible fabric panel is comprised of material selected from the group consisting of fabric or plastic.

4. The privacy structure of claim 1, wherein said panel privacy assembly comprises four in number.

* * * * *